US007195222B2

(12) United States Patent
Dent

(10) Patent No.: US 7,195,222 B2
(45) Date of Patent: Mar. 27, 2007

(54) FLANGED BASE AND BREAKAWAY SYSTEM CONNECTOR FOR ROAD ACCESSORY POSTS

(76) Inventor: Clifford M. Dent, P.O. Box 6007, Farmington, NM (US) 87499

( * ) Notice: Subject to any disclaimer, the term of this patent is extended or adjusted under 35 U.S.C. 154(b) by 3 days.

(21) Appl. No.: 11/113,259

(22) Filed: Apr. 22, 2005

(65) Prior Publication Data

US 2005/0284999 A1 Dec. 29, 2005

Related U.S. Application Data

(60) Provisional application No. 60/565,235, filed on Apr. 23, 2004.

(51) Int. Cl.
*F16M 13/00* (2006.01)

(52) U.S. Cl. ..... 248/511; 52/98; 248/519

(58) Field of Classification Search ..... 248/511, 248/519, 125.8; 135/16; 52/98; 403/2, 403/383; 256/65.14
See application file for complete search history.

(56) References Cited

U.S. PATENT DOCUMENTS 4,923,319 A * 5/1990 Dent ..... 403/2
5,354,031 A * 10/1994 Bilotti ..... 248/519
5,568,909 A * 10/1996 Timko ..... 248/519
5,685,517 A * 11/1997 Salibra ..... 248/519
6,868,641 B2 * 3/2005 Conner et al. ..... 52/98

* cited by examiner

*Primary Examiner*—Ramon O Ramirez
(74) *Attorney, Agent, or Firm*—Seed IP Law Group PLLC

(57) ABSTRACT

The present invention relates to a flanged connector and base receptacle for receiving posts of the of the standard types used to support roadside signs. A female socket of the receptacle is provided with multiple cross sectional shapes and/or sizes to securely and removably receive one of two or more different shapes and/or sizes of standard support posts. The base is readily attachable to the end of a length of bare post using a simple mechanical attachment. The invention includes a system of providing a breakaway joint which is easily installed as a retrofit to existing solid posts with minimal modification of such a post the post. The invention also simplifies service of a post which has been damaged in use. It is particularly adaptable to use with breakaway sign post systems.

14 Claims, 7 Drawing Sheets

FLANGED BASE AND BREAKAWAY SYSTEM CONNECTOR FOR ROAD ACCESSORY POSTS

RELATED APPLICATIONS

The present application is related to and claims priority to U.S. Provisional Application Ser. No. 60/565,235, filed Apr. 23, 2004 the contents of which are incorporated herein by reference.

BACKGROUND OF THE INVENTION

The present invention relates to a flanged connector and base receptacle for receiving multiple cross sectional shapes and/or sizes of posts of the type used to support roadside signs. The base is readily attachable to a length of bare post using a simple mechanical attachment. The invention includes a system of providing a breakaway joint which is easily installed as a retrofit to existing solid posts with minimal modification of such a post the post. The invention also simplifies service of a post which has been damaged in use. It is particularly adaptable to use with breakaway sign post systems and allows solid sign posts to be readily retrofitted with a breakaway joint.

SUMMARY OF THE INVENTION

It has become common for highway accessories including signs, fences, illumination, and guardrails to utilize a two-part support post. Such posts typically include a stub post anchored in the ground with one end projecting several inches above the ground to form a base for attachment of the signpost or light pole. A mounting flange is formed on or attached to the projecting end of the stub post. The signpost or light pole has a corresponding flange that is then bolted to the stub post flange.

In the interests of safety and in response to related governmental regulation the mounting system of such support posts often includes a rigid mounting assembly that can resist wind loads and light impacts while at the same time failing at a predetermined load, such as from a vehicle impact, to minimize damage to the support post and the vehicle, and to reduce injuries.

The present invention represents an improvement in implementing both simple flanged connections or two part breakaway systems particularly when such a system is to be retrofitted to existing solid signposts or when a breakaway signposts must be replaced due to damages sustained in an impact with a vehicle. The applicant's prior invention of a breakaway connector, which is the subject of U.S. Pat. No. 4,923,319, can be utilized to advantage in the present invention, as is described more fully herein below. This prior breakaway connector which comprises a breakaway bolt formed from a shaft having a shouldered breakaway shank section between two threaded ends will be referred to as a "Dent bolt" herein.

Simplifying the methods of assembly, repair and replacement of roadside posts is desirable for a number of reasons. First, due to the shear number of roadside accessories in place the labor cost of placing and maintaining these items is significant. By simplifying the structure the labor costs can be reduced. Safety is a factor which is reflected in several areas. The first of these arises from any downtime resulting from damage to a road safety feature, for example, a traffic sign or road illumination. Generally it will be desirable to return these items to service as quickly as possible. Additionally, simplifying the assembly or repair time minimizes the amount of time that road workers may be exposed to the hazards of working in high traffic areas. Since the safety benefit of breakaway sign posts is also well recognized, the present invention allows quicker and more efficient replacements of existing solid posts by simply adding a breakaway connector into the existing post structure thereby improving the safety of these roadside structures in an expedited manner and without requiring complete replacement.

The present invention relates to a flanged connector having a center receptacle designed to accommodate different types of post structures commonly used to support roadside accessories. Posts for such use have numerous cross-sectional configurations, such as round, square, U-channel, back-to-back U-channel, I-beam, rectangle, and other configuration. In any given region it is likely that more than one type of post structure will be used by road safety and maintenance authorities. The present invention provides a receptacle shaped so that two or more of these post types will fit in the same center section of the base system, thus simplifying the structures that must be kept on hand to assemble service and repair roadside accessories.

The utility of the present invention arises from providing an adaptable structure which simplifies and reduces the number of structures that must be kept on hand to assemble, service and repair roadside post-supported accessories. The invention provides a method of mechanically fastening a flange structure to a support post structure thereby reducing the need for on-site welding and speeding up the process of assembly, service, modification and repair of roadside accessories.

The flanged connector of the present invention is suitable for connecting a post segment to a fixed base such by being bolted directly to a concrete surface. The connector base of the present invention may also be used for attaching two post segments together either as a normal fixed flanged connection having flanges which directly abut one another, or by using the aforementioned Dent bolts between flanges to create a breakaway connection between post segments.

In its most common form, the device of the present invention provides a receptacle to accommodates both a square and a round post. It is recognized that a round posts will readily fit into a square female socket or receptacle if the diameter of the post is essentially equal to the length of one side of the square. Conversely a square or rectangular post will fit accurately into a round or cylindrical socket if the diagonal measurement of the post is essentially the same as the diameter of the cylindrical socket. However, the sizes of posts which are most commonly used for supporting roadway accessories are not generally found in such conveniently corresponding sizes. Accordingly the present invention provides for creating a base having a receptacle capable of receiving two different sized or shaped post cross-sections of commonly used sizes.

In the case of a receptacle to receive either a round or a square post, for a chosen diameter of round or cylindrical post, the receptacle can be sized to also receive any specific size of square post so long as the diagonal measurement of the cross-section of the square post is greater than the diameter of the round post and the length of a side of the square cross-section is less than the diameter of the cylindrical post.

Two different sized square posts can be accommodated in the same sockets by using a socket having an opening with an essentially eight pointed "star" as shown in FIG. 3, where the cross section of the opening is formed by superimposing one square concentrically on top of another where the squares are of different sizes and the orientation is such that no side of a first square is parallel to any side of the overlaid square. In this configuration a typical desirable orientation would be such that any side of the first square is oriented at some multiple of 45 degrees with respect to any side of the second square, or in other words, any diagonal of one square is parallel to two opposite sides of the second square. In this configuration the larger of the two squares could have a side length no greater than the length of a diagonal of the smaller square.

The receptacle of the present invention need not be comprised only of multiple combined polygonal shapes but can be formed in any appropriate configuration to accommodate multiple post cross sections of the type described above or any others which might be used or come into use. As used herein these various shapes of posts which can be received will be referred to as "geometric," such term including but not being limited to cross sections of regular or irregular polygons, round, oval, elliptical, channel, or I-beam as examples.

The present invention provides a flanged connector having a receptacle for receiving a bare end of posts of more than one such cross sectional size or shape, wherein the post end is inserted into the opening of the receptacle and set screws passing through the walls of the receptacle are tightened against the wall of the post within the receptacle to securely retain the post. While there are other suitable methods of securement of the post within the receptacle, such as bolts or cotter pins passing through the receptacle walls and the post itself, the use of set screws as described avoids any need to drill or otherwise modify the post section. However, simply having a receptacle capable of receiving and securing a bare post end is a novel and useful aspect of the invention.

It is an object of the present invention to provide a base for a sign those which is readily installed to existing sign posts without the need for welding or other labor-intensive fabrication methods.

It is another object of the present invention to provide a simple method of installing a flanged connector on a supporting post without the need to weld the flange in place.

It is another object of the present invention to provide a simple method of providing retrofitting existing solid sign posts with a breakaway joint.

It is another object of the present invention to provide a mounting base capable of accommodating multiple sizes and or shapes of post and therefore reduce the inventory of mounting bases which must be kept on hand for repair or retrofit purposes.

It is another object of the present invention to provide a single configuration of mounting base which can be used to provide a flanged connection between commonly used but differing post shapes or sizes, such as square to round.

It is another object of the present invention to provide a flanged connector capable of receiving and securing the bare end of a supporting post for roadside accessories.

DETAILED DESCRIPTION OF THE INVENTION

Figure 1:
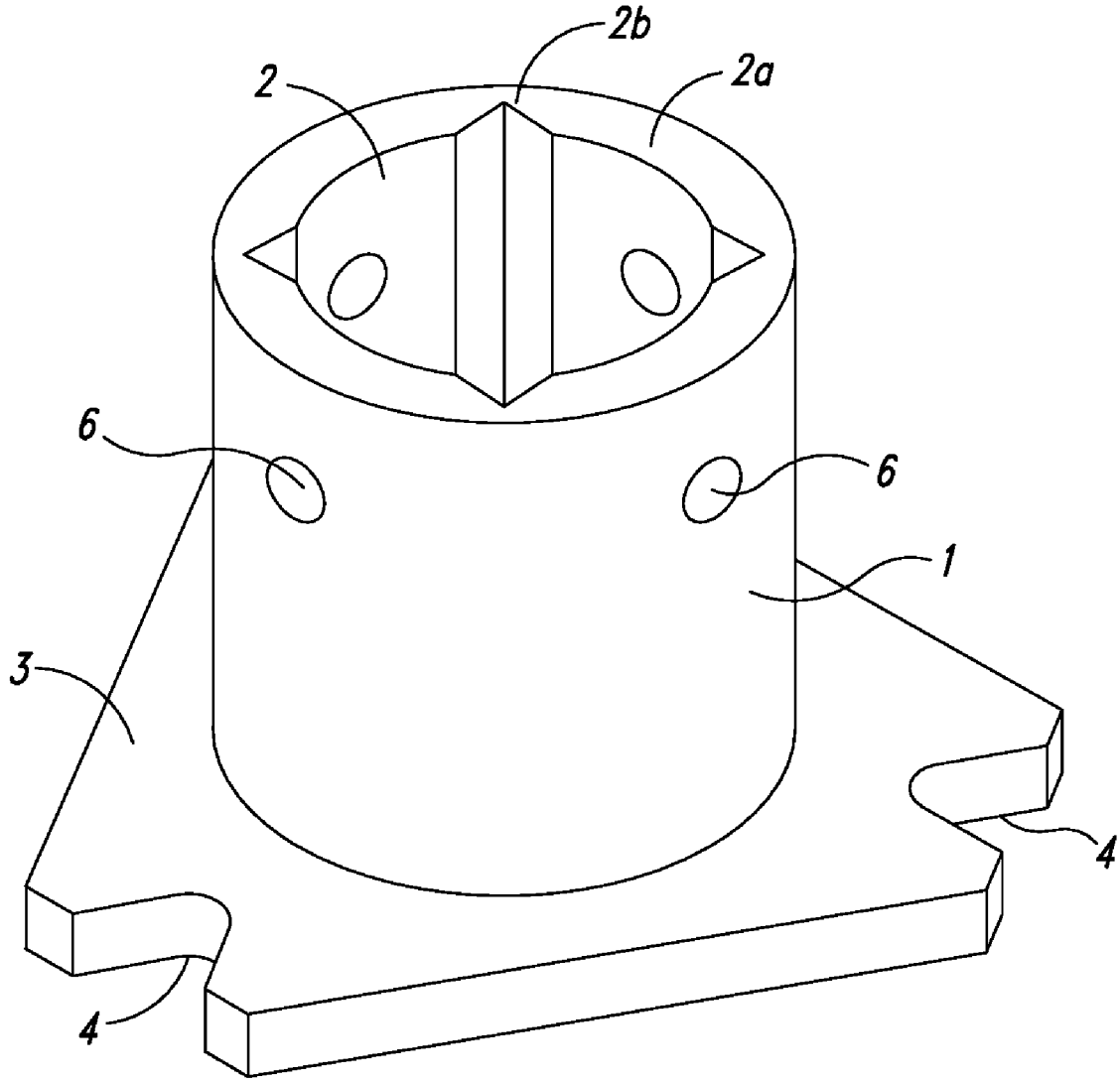
FIG. 1 is a perspective of the flanged base bracket assembly of the present invention having a receptacle to accommodate square or round posts.
Figure 6:
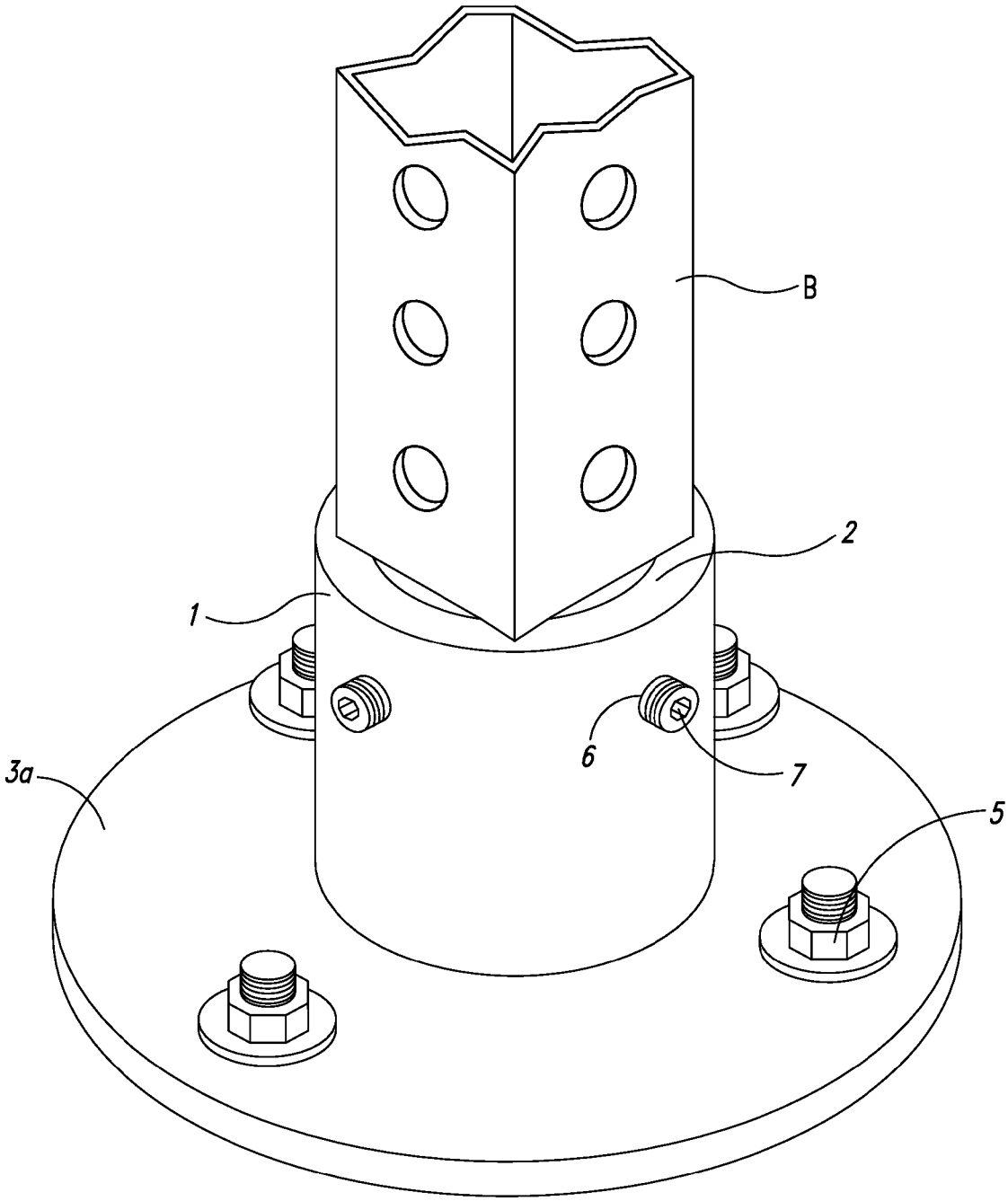
FIG. 6 is side view of a variation of the base of the preferred embodiment showing a square post in the receptacle and wherein the base has a round flange.
Figure 8:
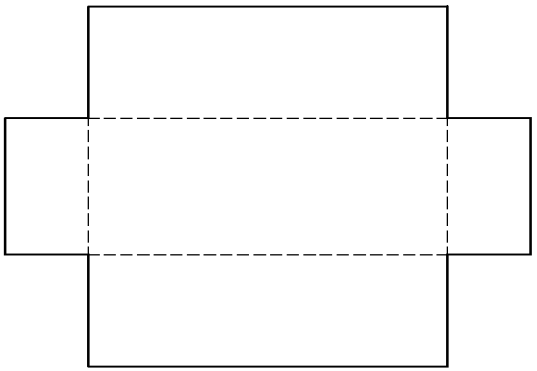
FIG. 8 illustrates the cross section of a post receptacle which can receive and secure either a rectangular or a square post section.

The present invention in its preferred form is a strong cast structure of ductile iron having a broad flat flange 3 show most clearly in FIG. 1. For use with roadside posts the flange 3 will be of triangular shape having a hole or recess 4 in each corner for receiving an anchoring or connecting member, such as a threaded bolt 5. For the purpose of creating a breakaway joint, a breakaway connector or Dent bolt 5*a* can be used at each recess or hole 4. While a triangular flange may be the most beneficial configuration for a breakaway joint which is supported in a stable "tripod" configuration on three breakaway bolts, any flange shape such as round or square may be suitable, especially if it is to be used to mate to an existing flange of a similar shape. A round flange 3*a* in a base receiving a square post B is shown in FIG. 6.

Figure 2:
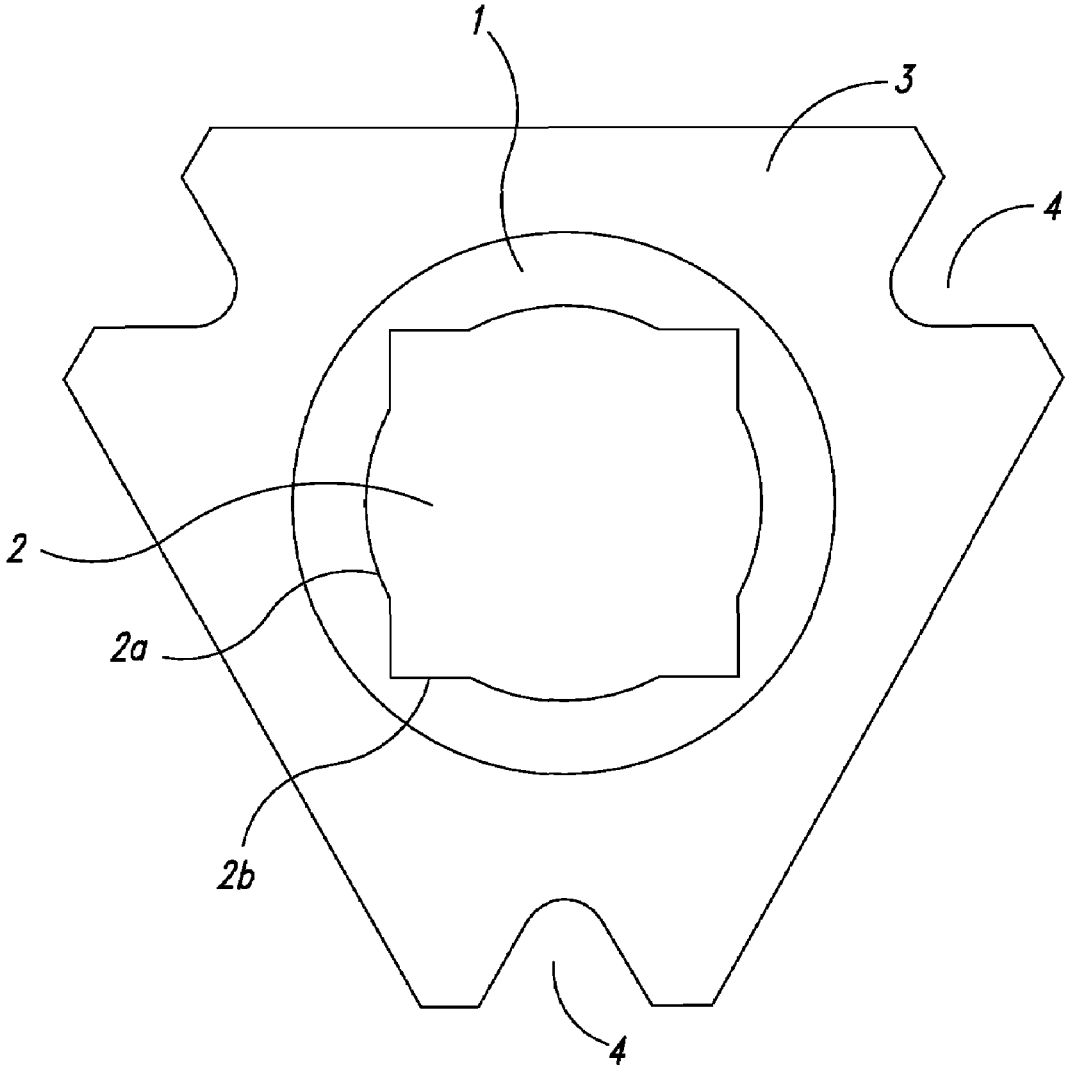
FIG. 2 is a plan view of the flanged base assembly of the present invention having a receptacle to accommodate square or round posts.
Figure 3:
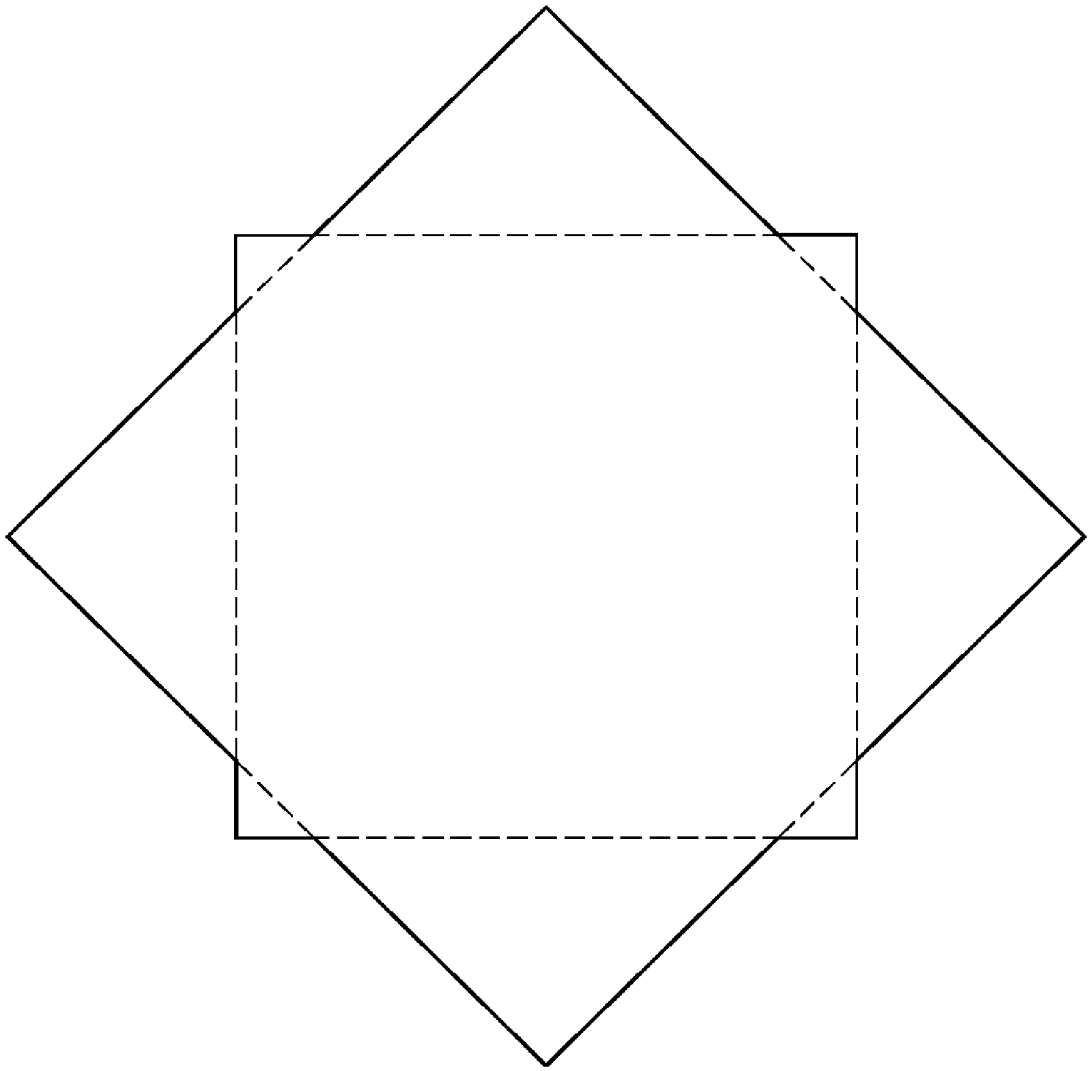
FIG. 3 illustrates the cross section of a post receptacle which can receive and secure different sizes of square post sections.
Figure 4:
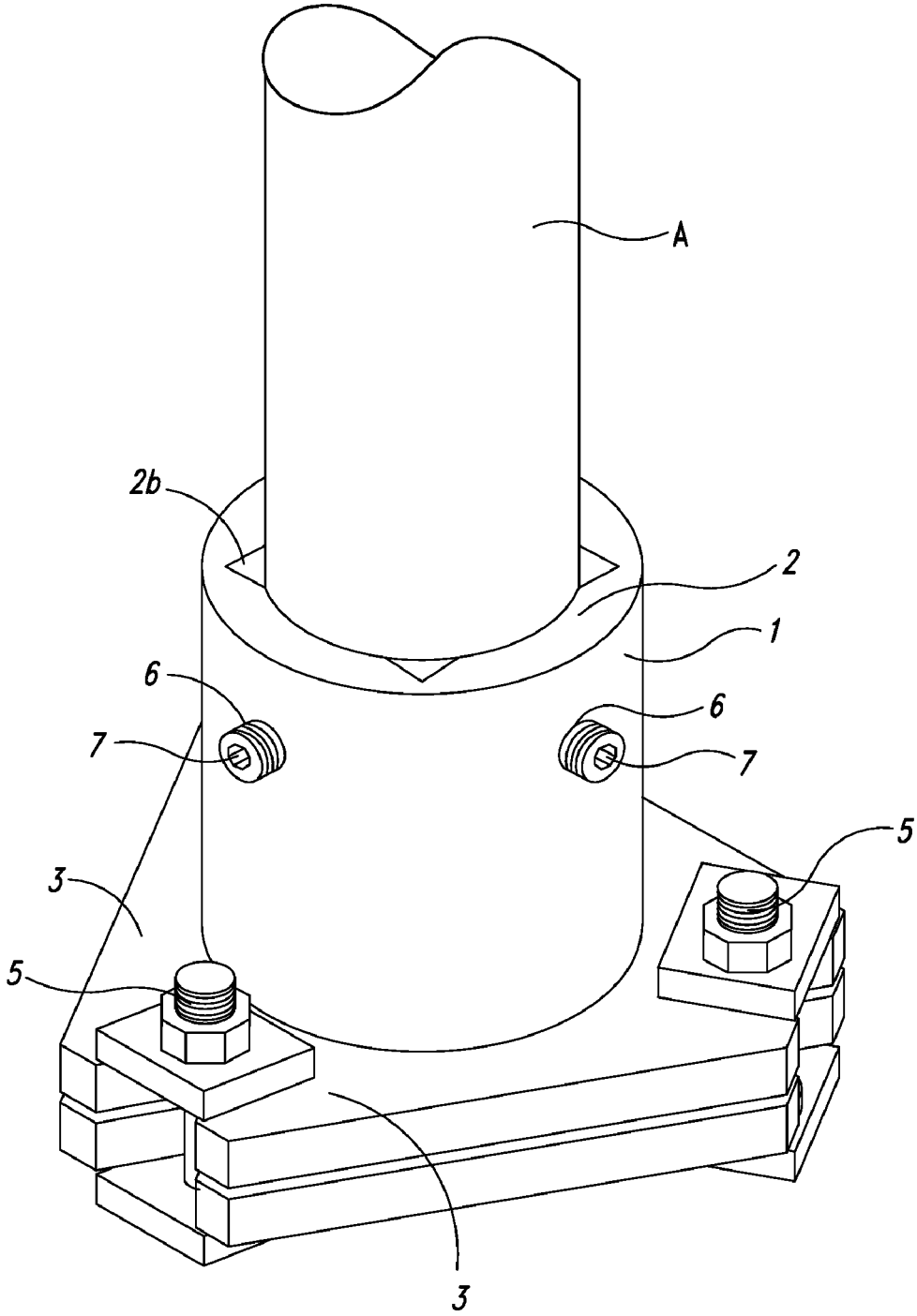
FIG. 4 is a perspective view of the flanged base as shown in FIG. 1 with a round post in place and further showing the use of bolts to secure the flange in place.
Figure 10:
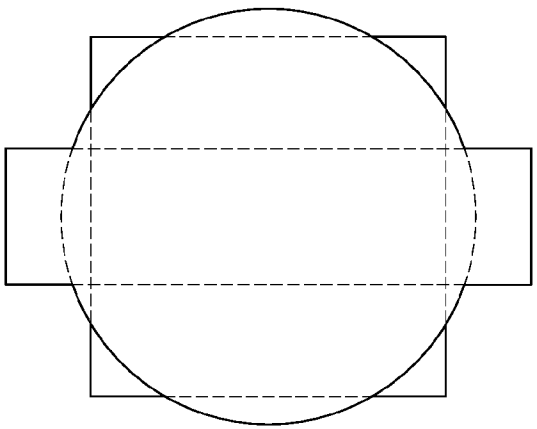
FIG. 10 illustrates the cross section of a post receptacle which can receive and secure either a rectangular, square or round post section.
Figure 7:
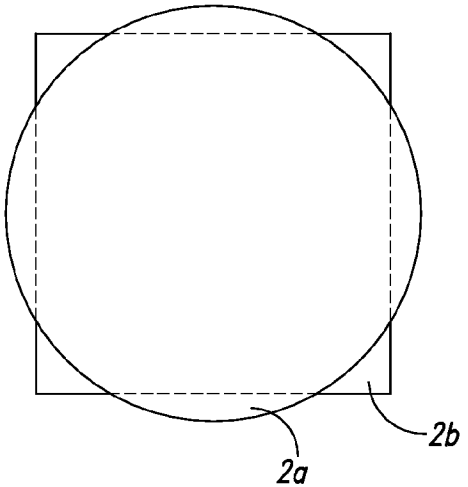
FIG. 7 illustrates the cross section of a post receptacle which can receive and secure either a round or a square post section.
Figure 9:
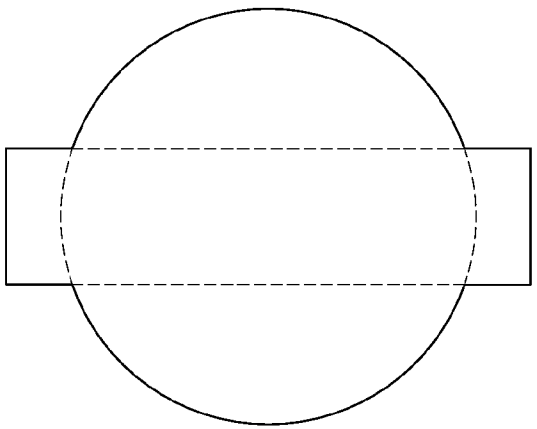
FIG. 9 illustrates the cross section of a post receptacle which can receive and secure either a rectangular or a round post section.

Extending from the flange is a post receiving structure 1, which will generally have a cylindrical exterior with an axis perpendicular to the general plane of the flange 3. The post receiving structure includes an opening or receptacle 2 which is generally coaxial with the cylindrical exterior of post receiver 1. As seen most clearly in FIGS. 2 and 7, in the preferred embodiment the cross sectional shape of the receptacle is defined by overlaid shapes, 2*a* being generally round or circular and 2*b* being square. It is to be understood that FIG. 3 and FIGS. 7 through 10 are intended merely as illustration of many of the possibilities of the overlaid shapes which can comprise the cross-section of the receptacle. The cross section of the receptacle socket can be comprised of a combination of any shapes of suitable size and shape wherein sufficient definition of each shape is retained to allow secure accommodation of a post cross section. In some cases it will be possible to have a receptacle cross section capable of securely accommodating more than two post shapes. Such an example is shown in FIG. 10 which shows the addition of a rectangular shape to the square and round combination shown in FIG. 7.

The socket is sized and shaped so that any post end which is to be received into the socket will fit "tightly," i.e. so that no significant lateral "play" or relative movement between the post and the socket is possible. Typically a socket with a cross section of two overlaid shapes will be able to accept either of two corresponding posts with a tight fit.

The wall of the post receiver 1 has multiple threaded openings 6 spaced appropriately around the circumference of the receiver to allow threaded set screws 7 to be inserted therein to tighten against a surface of a post to secure the post within the receptacle.

Figure 5:
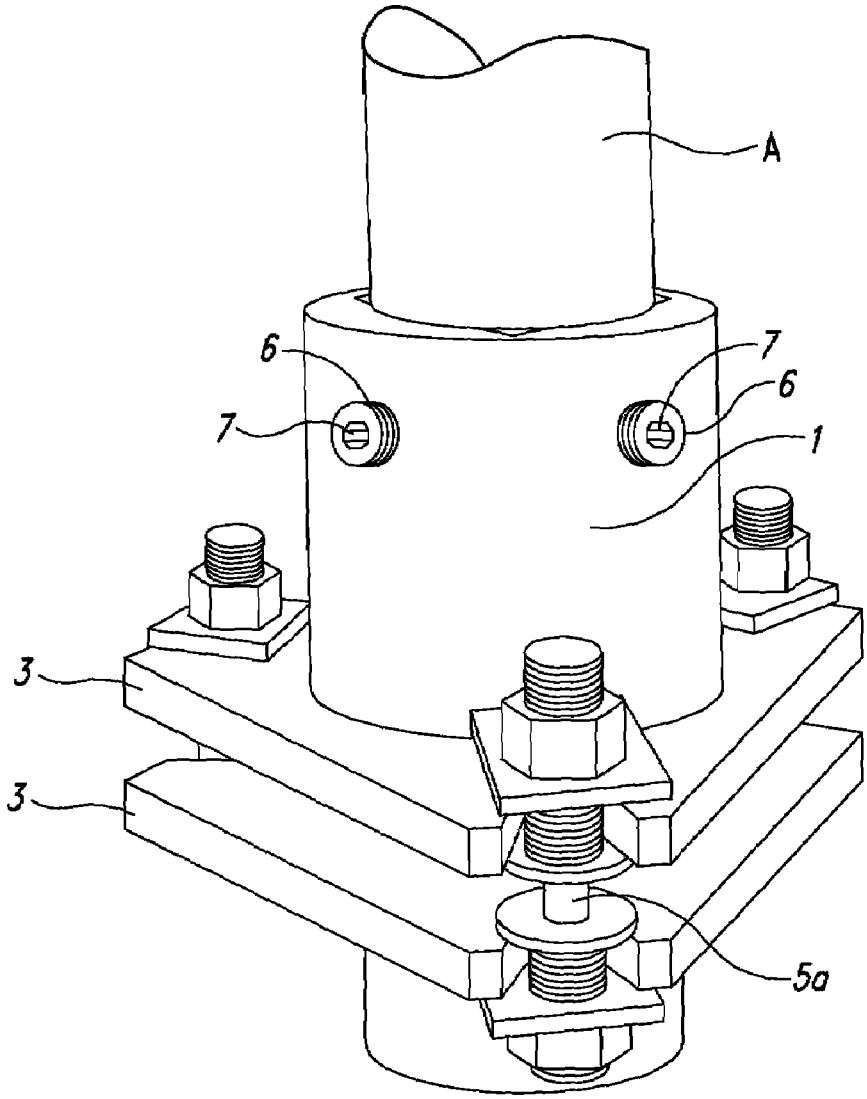
FIG. 5 is side view of a breakaway joint using two matched flanged base assemblies of the present invention.

When used to create a joint between post sections as shown as shown in FIG. 5, so long the flanges are designed to mate, as it is not necessary that the post sections be of the same cross sectional size or shape.

What is claimed is:

1. A base receptacle for receiving an end of a road sign post having a cross-sectional geometric shape, the receptacle comprising:

a flanged portion adapted for attachment to a solid surface or a mating flange;

a socket oriented generally perpendicular to said flange portion, the socket sized and shaped to accept said post end, the socket having a cross-sectional configuration comprising a plurality of geometric shapes, of which one geometric shape corresponds to the cross-sectional shape of the post; and fastening means for mechanically securing said post end into said socket in a removable fashion.

2. The base receptacle of claim 1 wherein a first geometric shape is polygon and a second geometric shape is circular.

3. A joint for connecting two post sections, the joint comprising:

two base receptacles, each base receptacle comprising:

a flange adapted for attachment to a solid surface or a mating flange;

a socket oriented generally perpendicular to said flange, the socket sized and shaped to accept said post end, the socket having a cross-sectional configuration comprising a plurality of geometric shapes, of which one geometric shape corresponds to the cross-sectional shape of the post; and fastening means for mechanically scuring said post end into said socket in a removable fashion.

4. The joint of claim 3 wherein the first and second base receptacles are secured together with breakaway bolts.

5. A receptacle for holding a post having a mounting end with a geometric cross-sectional configuration, the device comprising:

a receiver having an opening with a cross-sectional configuration comprising multiple overlaid geometric shapes, at least one geometric shape matching the geometric cross-sectional configuration of the mounting end of the post, the opening of the receiver sized and shaped to receive the mounting end of the post in slidable engagement.

6. The device of claim 5, comprising a flange extending from the receiver, the flange comprising at least one attachment portion.

7. The device of claim 5, further comprising fastener openings in a side wall of the receiver in communication with the opening for receiving the mounting end of the post.

8. A device for accepting posts of different cross-sectional configurations for mounting onto a support structure, the device comprising:

a wall circumscribing an internal cavity and defining an open end in communication with the internal cavity, the circumscribing wall defining a plurality of cross-sectional configurations.

9. The device of claim 8, comprising a flange extending from the circumscribing wall and away from the internal cavity.

10. The device of claim 9 wherein the flange extends across the internal cavity to form a closed end.

11. The device of claim 9, comprising a breakaway fastener attaching the flange to a flange member extending from a support structure.

12. The device of claim 8, further comprising at least one opening in the circumscribing wall adapted to receive a set screw.

13. The device of claim 8 wherein the cross-sectional configurations comprise at least two from among a square, a circle, a rectangle, a pentagon, a hexagon, and an octagon.

14. The device of claim 8 wherein the cross-sectional configurations comprise geometric shapes.

* * * * *